US009945644B2

(12) United States Patent
Fouques et al.

(10) Patent No.: US 9,945,644 B2
(45) Date of Patent: Apr. 17, 2018

(54) MACHINE FOR LAUNCHING TARGETS AND ITS ADJUSTMENT METHOD

(71) Applicant: LAPORTE HOLDING, Biot (FR)

(72) Inventors: Jean-Marc Fouques, Claviers (FR); Jean-Michel Laporte, Biot (FR)

(73) Assignee: LAPORTE HOLDING (SAS), Biot (FR)

( * ) Notice: Subject to any disclaimer, the term of this patent is extended or adjusted under 35 U.S.C. 154(b) by 0 days.

(21) Appl. No.: 15/537,044

(22) PCT Filed: Dec. 9, 2015

(86) PCT No.: PCT/EP2015/079056
§ 371 (c)(1),
(2) Date: Jun. 16, 2017

(87) PCT Pub. No.: WO2016/096552
PCT Pub. Date: Jun. 23, 2016

(65) Prior Publication Data

US 2018/0010893 A1 Jan. 11, 2018

(30) Foreign Application Priority Data

Dec. 17, 2014 (FR) ..... 14 62607

(51) Int. Cl.
*F41J 9/18* (2006.01)
*F41J 9/30* (2006.01)
*F41J 9/24* (2006.01)

(52) U.S. Cl.
CPC . *F41J 9/30* (2013.01); *F41J 9/18* (2013.01); *F41J 9/24* (2013.01)

(58) Field of Classification Search
CPC ..... F41J 9/18
See application file for complete search history.

(56) References Cited

U.S. PATENT DOCUMENTS

| | | | | |
|---|---|---|---|---|
| 2,711,726 | A * | 6/1955 | Darrell | F41J 9/18 124/32 |
| 5,871,003 | A | 2/1999 | Laporte et al. | |
| 9,605,931 | B2 | 3/2017 | Laporte et al. | |
| 2002/0112712 | A1 | 8/2002 | Gustafsson | |

FOREIGN PATENT DOCUMENTS

| | | |
|---|---|---|
| WO | 96/18864 | 6/1996 |
| WO | 2014/005952 | 1/2014 |

OTHER PUBLICATIONS

International Search Report for corresponding International PCT Application No. PCT/EP2015/079056.

* cited by examiner

*Primary Examiner* — John Ricci
(74) *Attorney, Agent, or Firm* — Hauptman Ham, LLP

(57) ABSTRACT

A machine for launching targets, comprising a chassis on which a support is mounted. A barrel is rotatably mounted about an axis of rotation, the barrel comprising a plurality of columns for storing stacked targets. The columns each have an axis parallel to the axis of rotation. The chassis comprises a surface for receiving targets for a launch, the support comprising a hole configured to allow the passage of a target from a column of the barrel to the receiving surface. The support comprises a first locking position with respect to the chassis and at least a second locking position with respect to the chassis, the first position and the second position having an angular offset along the axis of rotation.

14 Claims, 4 Drawing Sheets

MACHINE FOR LAUNCHING TARGETS AND ITS ADJUSTMENT METHOD

FIELD OF THE INVENTION

Figure 1:
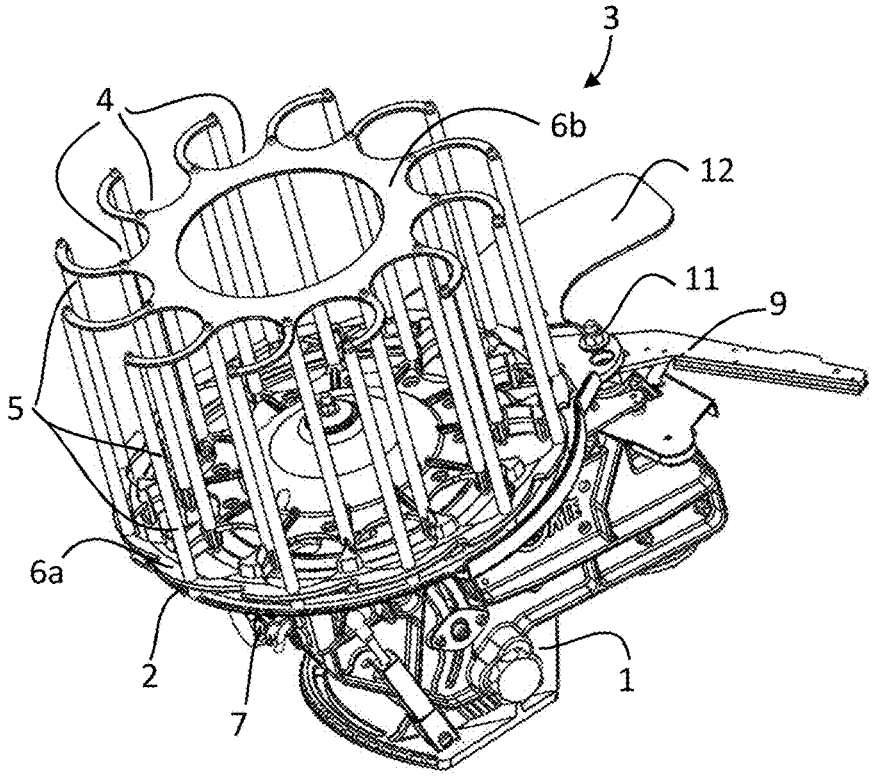

The present invention relates to a machine for launching targets and a method for adjusting this machine.

It can be used in the field of projecting targets for ball trap shooting for which targets in the shape of plates in the shape of a saucer, often called clay pigeons, are used.

PRIOR ART

Machines allowing targets to be launched have been known for several decades. These machines generally use a rotatably mounted launching arm loaded, for example by a spring tension system, in such a way that the triggering of the rotation of the arm, on command, generates a quick movement of the arm. The latter intercepts a target placed on a projection surface and the target is projected at a fast speed.

In the most highly developed machines, it is possible to launch a large number of targets without reloading the machine. For this purpose, the machine comprises a magazine for storing targets, the targets being delivered one by one to the projection surface. One magazine design comprises a barrel having a movement of rotation. The barrel incorporates a plurality of columns allowing each to store a plurality of superimposed targets. The rotational movement of the barrel ensures the sequential positioning of one of the columns opposite a hole allowing the delivery of the target placed the lowest in the column to the projection surface.

Generally, the sequential rotation of the barrel (the angular pitch of which is dependent on the number of columns) is coupled to the rotational cycle of the arm, one cycle of the arm generating a movement of the barrel in such a way as to place a following column opposite the hole and thus, by this circular movement, progressively empty the columns of the barrel.

On the basis of this technology, the offer of a variety of shooting possibilities was sought, so as to multiply the exercise configurations of the ball trap. One of the possibilities involves varying the direction of rotation of the launching arm in order to produce a projection by the right side or by the left side of the machine. Machines were thus proposed for which the arm, and thus also the barrel, rotate in the counterclockwise direction and, in addition to the machines for which the arm and the barrel rotate in the clockwise direction. As a result, there needs to be a plurality of specific machines—at least two—in order to provide this variety of shots.

There is a need to allow target-launching alternatives, in particular with different rotations of the arm, without leading to a multiplication of the costs. Also, in general, there is a need to adjust the direction of projection of the machines.

SUMMARY OT THE INVENTION

The present invention relates, according to one aspect, to a machine for launching targets, comprising a chassis on which a support is mounted, relative to which a barrel is mounted rotatably about an axis of rotation, the barrel comprising a plurality of columns for storing stacked targets, the columns each having a longitudinal axis parallel to the axis of rotation, the chassis comprising a surface for receiving targets for a launch, the support comprising a hole configured to allow the passage of a target from a column of the barrel to the receiving surface.

According to an advantageous aspect, the support comprises a first locking position with respect to the chassis and at least a second locking position with respect to the chassis, the first position and the second position having an angular offset in a direction parallel to the axis of rotation.

The direction of projection of the target can thus be adjusted. This is useful in particular for compensating for the effects of the inertia of the target passing through the hole. More specifically, the target in question passes through the hole after having first been subjected to a force, substantially tangential to the trajectory of the barrel, due to the rotation of the latter. The target does not therefore fall onto the receiving surface with only its weight being applied, but also with a component related to its inertia in this movement caused by the rotation of the barrel. In practice, the target does not reach the receiving surface exactly vertically in line with the hole, but in a slightly offset manner.

The presence of two angular positions for the support allows the position of the hole to be moved in order to take into account the natural offsetting of the target. One use for this adjustment is to allow operation of the machine either in a first direction of rotation of the arm or in an opposite direction while keeping the same direction of rotation of the barrel (and thus avoiding the need to design and produce barrels dedicated to a single direction of rotation of the arm). In practice, because of the invention, the user can use the machine in a direction of rotation of the arm corresponding to that of the barrel, then simply mount the arm (and optionally the receiving surface) in order for the arm to rotate in the opposite direction and produce a target launch on another side of the machine. As for the barrel, it remains in place and its direction of rotation is not modified. The position of the target falling onto the receiving surface is simply corrected by modifying the angular position of the support, in order to take into account the fact that the barrel and the arm rotate in opposite directions this time. A fixed starting position of the target, on the receiving surface, with respect to the arm is thus always ensured. Only the direction of rotation of the arm is modified.

Thus, a modifiable machine with two directions of rotation of the arm is provided by simply adding one or more supports for locking the receiving surface and especially by using 100% of the parts of the original machine; the manufacturing is standardized.

The adjustment of a trajectory is obtained by an angular adjustment of the base of the machine with respect to its support. This is a very simple and very quick operation. Modifying the position of the barrel in order to obtain a similar effect would take much longer to carry out especially if the machine is full.

The invention also relates to a method.

INTRODUCTION TO THE DRAWINGS

Figure 2:
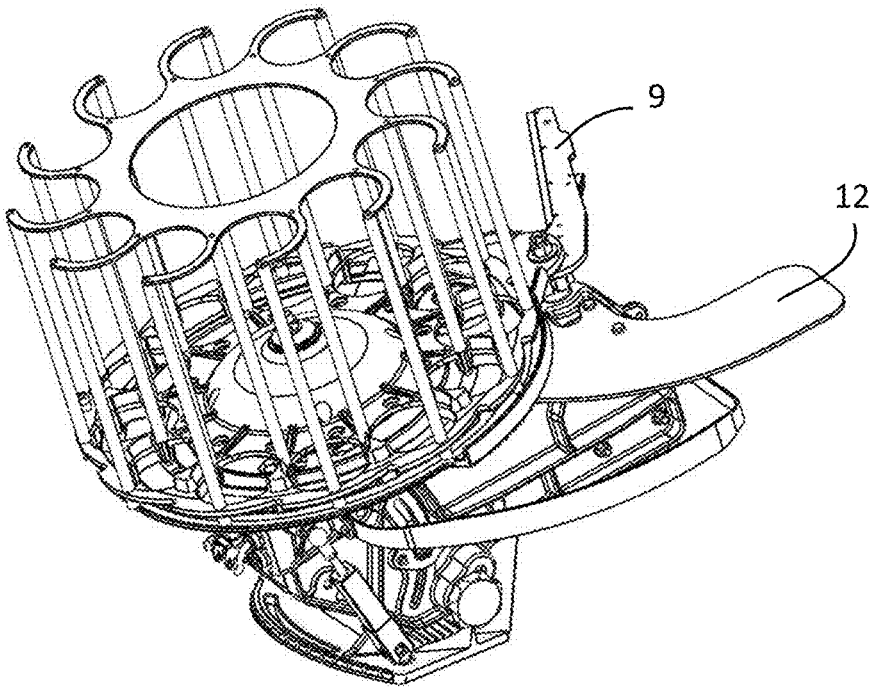
Figure 3:
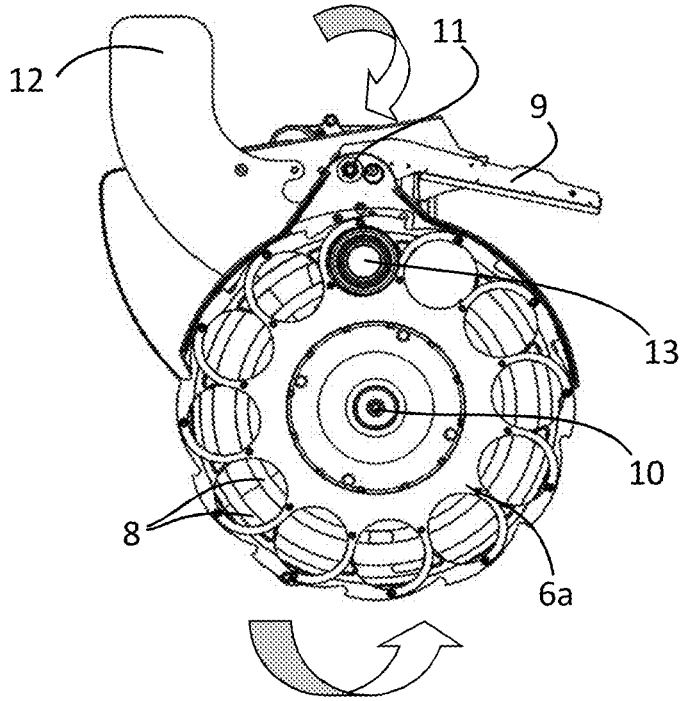
Figure 4:
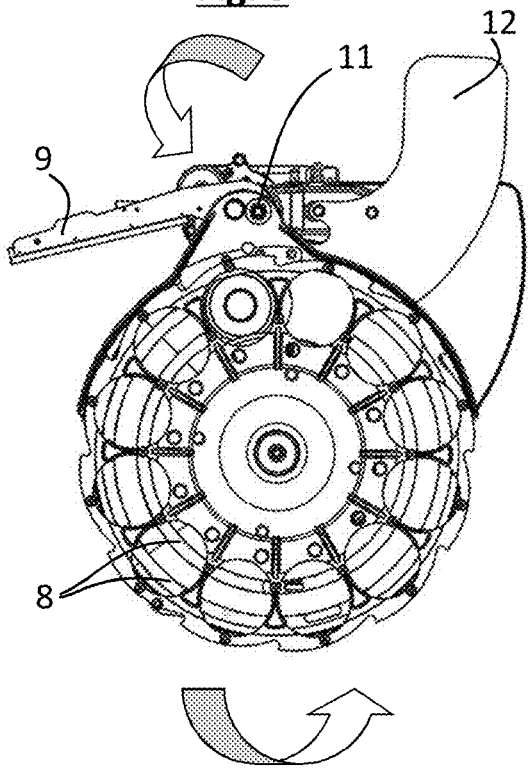
Figure 5:
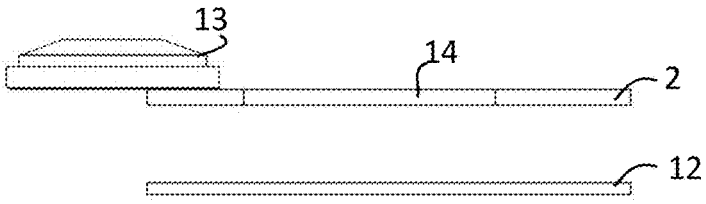
Figure 6:
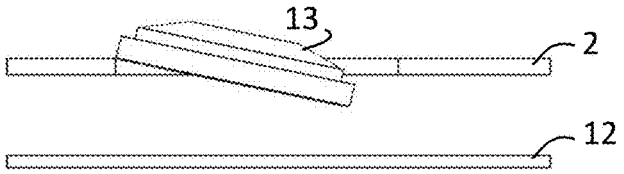
Figure 7:
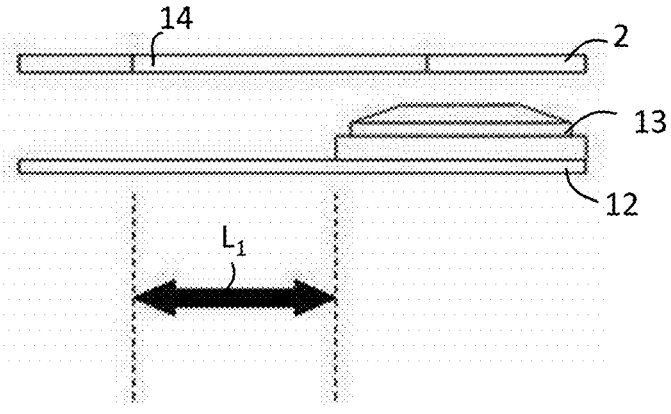
Figure 8:
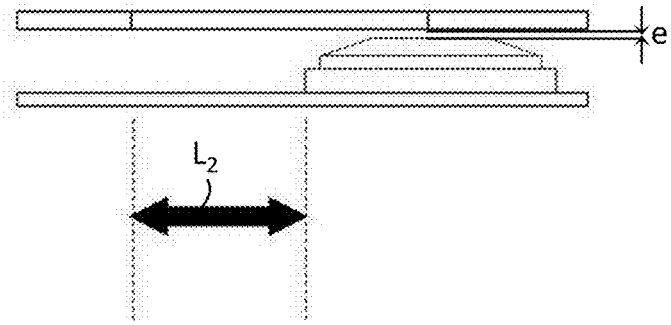
Figure 9:
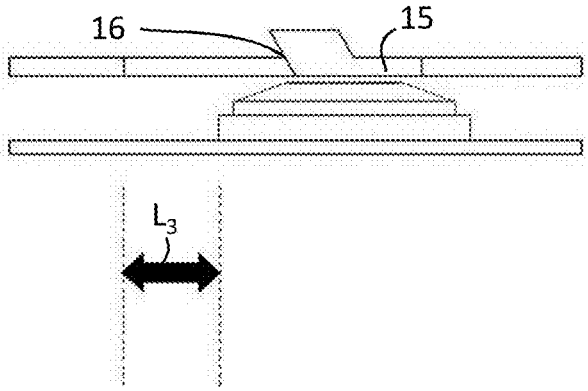
Figure 10:
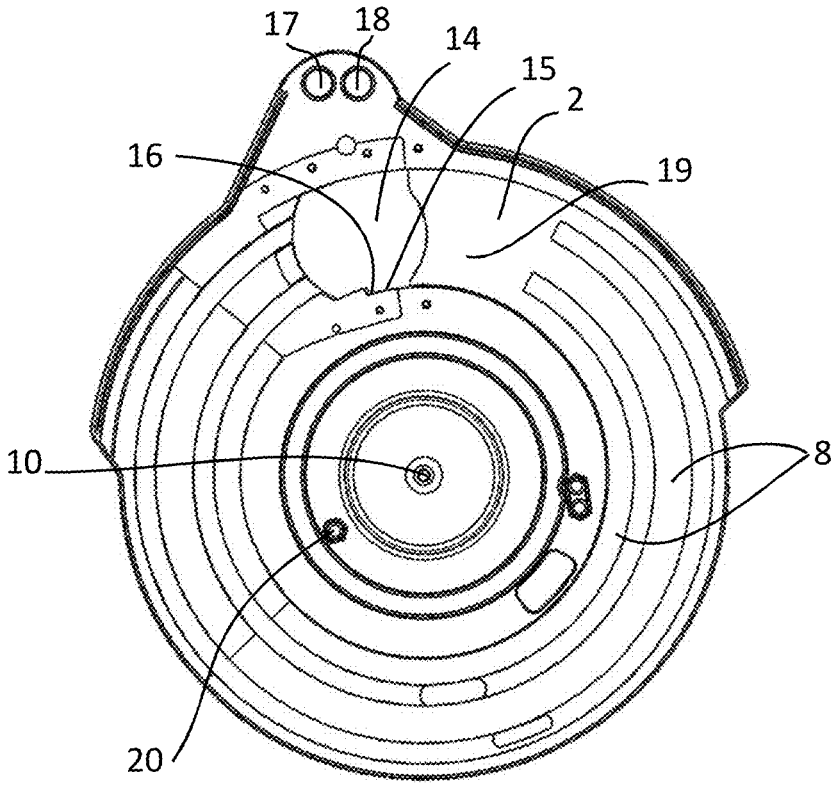
Figure 11:
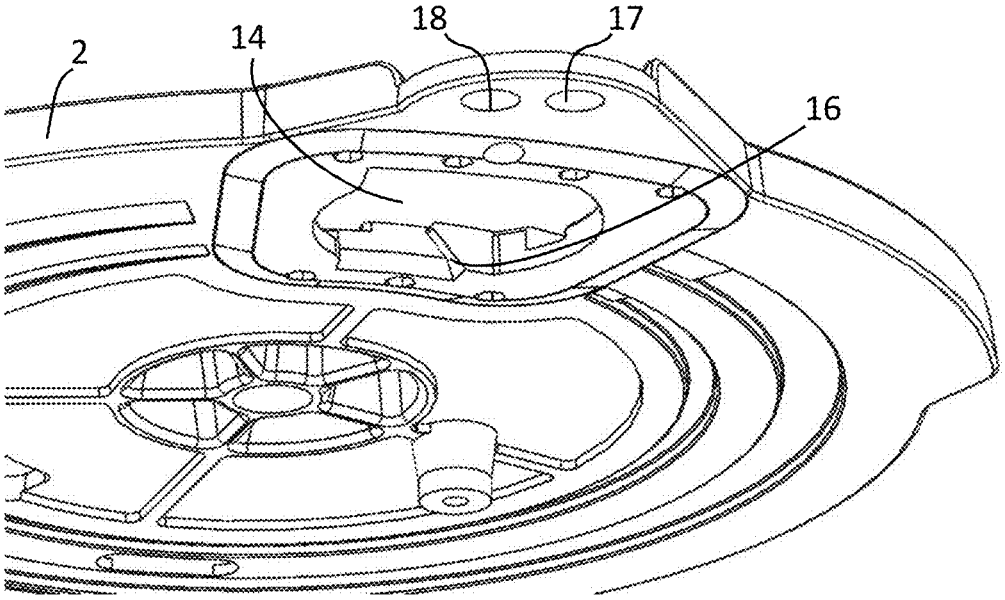

The invention will be better understood with the drawings appended to the present description, which present non-limiting embodiments of the invention in the following drawings:

FIG. 1 which presents a perspective view of a first embodiment of the invention;

FIG. 2 which presents this embodiment of the invention with the launch of targets being carried out symmetrically;

FIGS. 3 and 4 which present overhead views of FIGS. 1 and 2, respectively;

FIGS. 5 to 7 which schematically present the kinematics of a target being loaded before its launch by the launching arm;

FIG. 8 which presents one aspect of the invention;

FIG. 9 which shows the possibility of modifying the trajectory of a target during its loading before launch;

FIG. 10 which shows an overhead view of a supporting part of the invention;

FIG. 11 which shows a detail of the supporting part.

DETAILED DESCRIPTION

Before describing embodiments of the invention, in particular in reference to the drawings, options that the invention can optionally have in any possible combination are presented below.

- the angular offset is between 2 and 15° and preferably 5°.
- the machine comprises a pivot link between the support and the chassis along the axis of rotation and a system for immobilizing the movement of the support on the pivot link in each of the first position and the second position;
- the distance separating the hole and the receiving surface along the direction of the axis of rotation is configured in such a way that the residual clearance (e) between an upper surface of a target (13) placed on the receiving surface (12) of a lower surface of the support (2) opposite the target (13) is less than or equal to 3 mm;
- the support (2) and the receiving surface (12) are parallel;
- the machine comprises a deflector configured to guide a target (13) passing through the hole towards the receiving surface (12);
- the deflector comprises a wall inclined with respect to the direction of the axis of rotation and located at the edge of the hole;
- the inclined wall is inclined at an angle of between 30° and 60° and preferably of 45° with respect to the direction of the axis of rotation when moving away from the center of the hole towards the receiving surface;
- an arm for launching a target positioned on the receiving surface is rotatably mounted in such way as to reversible in two directions of rotation;
- a coupling device is configured to produce a rotation of the barrel in a single direction of rotation during a rotation of the arm in one out of the two directions of rotation;
- the receiving surface is mounted on the chassis in a first position when the arm is mounted in a first direction of rotation and in a second position when the arm is mounted rotatably in a second direction of rotation.
- the direction of launch of a target is adjusted by selecting one out of the first position and the second position of the support.
- the first position of the support is selected when the arm is mounted rotatably in the first direction of rotation and the second position is selected when the arm is mounted rotatably in the second direction of rotation;
- the first position and the second position of the support are defined in such a way as to produce the same direction of launch of a target in the first and second directions of rotation of the arm.

In reference to FIG. 1, the machine of the invention can comprise a chassis 1, for example made of metal allowing bearing on the ground or on any other surface of the machine. The chassis typically comprises a lower bearing surface and supports a plurality of functional elements allowing the launch of the target. In particular, the chassis receives a motor 7, preferably electric, allowing a spring cinematically linked to a launching arm 9 to be loaded via a system of transmission of movements. When the spring is loaded, a controlled trigger system allows the spring to be released and a sudden movement of the arm 9 to be carried out in such a way as to produce the energy for launching a target 13. Conventional systems of gear motors, springs and launching arms can be used in the context of the invention. One example of a launching arm 9 is shown in FIGS. 1 to 4 with an axis of rotation 11 about which the arm is rotatably mounted during its actuation in order to launch a target 13. A front portion of the launching arm ensures the contact with a target 13. In general, the launching arm 9 can have a substantially elongated configuration between a proximal end at which the axis of rotation 11 is located and a distal end. The angular displacement of the launching arm 9 occurs partly above a receiving surface 12 onto which at least one target 13 can be loaded in order to produce the launch. The distance offsetting, along the axis of rotation 11 between the launching arm 9 and the receiving surface 12, is adjusted in such a way that the launching arm 9 touches the side of the target 13 to be projected. Preferably, the receiving surface 12 is perpendicular to the axis of rotation 11.

The system for actuating the launching arm 9 functions in a cyclical manner in such a way that, after the release of the spring, the launching arm 9 is brought back from a rest position to a reloaded position via the action of the motor 7.

Such a machine allows the launch of at least one target 13 during such a movement. In order to make the machine autonomous in the launching of a large number of targets 13, the machine advantageously comprises a barrel 3 in which a plurality of targets 13 can be stored. More specifically, the barrel 3 comprises a plurality of columns 4, these columns extending in parallel to each other and being organized in an angular sector, at the edge of the barrel 3, around an axis 10. The number of columns 4 is not limited. Each column 4 is for example defined by rods 5 extending along the axis 10 and acting as lateral stop surface for the targets 13 that are stacked in each of the columns 4. Thus, sets of targets 13 superimposed on each other are formed. In the upper portion of the barrel 4, an upper frame **6*b* is advantageously positioned in order to connect together all the distal ends of the rods 5. In the lower portion, the barrel 3 advantageously comprises a lower frame having the same function as the upper frame but in order to connect together the proximal ends of the rods 5. The terms "lower" and "upper" are, unless another arrangement is made in the present description, to mean a relative position of parts with respect to the action of gravity in the movement of the targets 13**.

As shown, the lower frame **6*a* defines openings for each column 4 in such a way that a target 13 placed in the lowest position in a column 4 is capable of being extracted from the barrel 3 by its lower end. At this location, on the wall of the lower frame 6*a* opposite the rest of the barrel 3, there is a support 2 allowing the targets 13 to be retained in the columns 4 by opposing gravity. Preferably, in order to limit friction, the support 2 comprises a retaining surface 8, for example in the form of two annular portions extending along the trajectory of the columns 4 around the axis 10 in such a way as to produce local bearing of the lower wall of the targets 13 placed in the lowest position of each column 4. The retaining surface 8 advantageously does not extend over the entire angular displacement of the support 2 in such a way as to leave a portion having a lower level than that of the retaining surfaces 8 at the support 2. This portion is illustrated in the form of a transfer zone 19 in FIG. 10. The barrel 3 is mounted rotatably about the axis 10 in such a way that the columns 4 advance progressively according to this movement of rotation. Advantageously, the movement of rotation of the barrel 3 about the axis 10 is carried out sequentially, with steps corresponding to 360° divided by the number of columns. Again preferably, the sequential movement of the barrel 3 is coupled to that of the launching arm 9 in such a way as to use a shared motor for these two movements. Thus, each launch cycle of the arm 9 generates a movement of the barrel 3 in a sequential manner with steps determined according to the number of columns 4**.

The support 2 comprises, as shown in particular in FIG. 10, a hole 14 through which a target 13 can pass from a column 4 of the barrel 3 to the receiving surface 12. The hole 14 is located along the trajectory of the columns 4 in such a way that successively, one of the columns 4 arrives, at its lower end, opposite the hole 14. Thus, the target 13 located the lowest in the column 4 opposite the hole 14 can pass through the latter and move towards the receiving surface 12. During this movement, a system for retaining the other targets 13 of the column 4 in question is provided.

In reference to FIGS. 5 and 6 and to FIG. 10, the path of a target 13 in preparation for its projection is explained in more detail. First, the target 13 that is located the lowest in one of the columns 4 moves during the successive movements of rotation of the barrel 3 around the axis 10, the target 13 being retained, in opposition to its gravity, by the retaining surfaces 8.

In reference to FIG. 10, which shows a barrel 3 mounted rotatably in the counterclockwise direction, the target 13 of the column 4 in question progressively arrives in the transfer zone 19. This zone is advantageously located at a height level lower than the retaining surfaces 8. Moreover, the latter surfaces 8 can be organized in the form of a ramp in such a way that the level of the target 13 in question decreases progressively in the direction of the transfer zone 19. Once in the transfer zone 19, the target 13 is offset with respect to the rest of the stack of targets of the column 4 in question and continues its movement, in the counterclockwise direction, towards the hole 14. At this level, the target 13 passes through the hole 14 and ends up, because of its fall, on the receiving surface 12. This mechanism is illustrated in FIGS. 5 and 6. In particular, in FIG. 5, the target 13 is located in the transfer zone 19 and, by continuing to be driven by the rotation of the barrel 3, progressively arrives at the hole 14. When the target 13 is sufficiently above the hole 14, it passes through the latter as shown in FIG. 6. Via gravity, the target 13 thus passes from the support 2 to the receiving surface 12. The result obtained is illustrated in FIG. 7.

The example of FIGS. 5 to 7 illustrates this advance of the target 13 and its descent onto the receiving surface 12 and also outlines an offset between the location of the target 13 at the end of its path, bearing on the receiving surface 12 with respect to the edge of the hole 14. Thus, FIG. 7 shows a distance $L_1$ between the upstream edge of the hole 14 relative to the direction of rotation of the barrel 3 and the upstream edge of the side of the target 13 on the receiving surface 12. The distance $L_1$ reflects that the kinetic energy of the target 13 has caused an offset from being vertically in line with the hole 14 in such a way that the target 13 is not located exactly opposite the hole 14 at the end of its movement of transfer. This offset is not conducive to the precise adjustment of the launch of the target 13 because the position of the target 13 on the receiving surface 12 is capable of modifying the trajectory of launch by the launching arm 9. Moreover, is the machine is reversed, for use with a rotation of the launching arm 9 in the opposite direction, this offset has an effect opposite to the preceding case on the relative position of the arm 9 and the target 13.

In order to limit the influence of this lateral offsetting of the target 13, an aspect of to the invention is preferably implemented in which the offset between the support 2 and the receiving surface 12 is very small in the direction of the axis of rotation 10 in order to produce a significant reduction in the lateral offset between the hole 14 and the upstream side of the target 13. The effect of this reduction of distance between the support 2 and the receiving surface 12 is illustrated in FIG. 8 with an offset $L_2$ that is greatly reduced. Preferably, the offset between the support 2 at the hole 14 and the receiving surface 12 is such that the residual clearance between the lower surface of the support 2 and the upper surface of the target 13 positioned on the receiving surface 12 is less than 3 mm and preferably less than 2 mm. This dimension is labeled "e" in FIG. 8.

For example, the height of the target 13 can be approximately 20 to 30 mm and for example approximately 25 mm. An offset of 27 mm between the lower wall of the support 2 in the zone of the hole 14 and the upper wall of the receiving surface 12 provides a residual clearance "e" of 2 mm.

Since the targets have a standardized height in most cases, the offset can be set during manufacturing. Optionally, a system for adjusting the offset can be incorporated.

According to another aspect of the invention, again with the goal of limiting the offsetting of the target 13 during its loading onto the receiving surface 12, the present invention can have, at the hole 14, a deflector 16 configured to limit the component, oriented in the plane of the support 2, of movements of the target 13 passing through the hole 14. For this purpose, the deflector 16 has a configuration allowing bearing on an area of the outer contour of the target 13 in order to force the movement of the target 13 downwards, that is to say, along the axis of rotation 10. Thus, the component of movements along the axis of rotation 10 is promoted for the target 13 by limiting the component that is perpendicular to it via the bearing on the deflector 16. Preferably, the deflector 16 comprises an inclined flat surface, this incline going towards the outside of the hole 14 when going from the support 2 to the receiving surface 12. An example of a deflector 16 is shown in FIG. 9. The location of the latter on the support 2 appears in particular in FIG. 10, a figure in which the deflector 16 is located at the edge of the hole 14. FIG. 11 shows another view of the deflector 16 viewed from below the support 2. The inclination of the deflector is preferably between 30° and 60° and in particular 45°. It is understood that the deflector allows the advance of the target 13 on the receiving surface 12 during its fall to be limited. Thus, the offset between the hole 14 and the target 13 is also limited as reflected by the distance $L_3$ shown in FIG. 9. In an advantageous and non-limiting manner, advantage is taken of both the deflector 16 and the fact that the receiving surface 12 and the support 2 are brought closer together.

In a non-limiting manner, this capacity for adjustment can be used to indifferently produce, via the invention, a machine capable of launching targets from the right or from the left. FIGS. 1 and 3 show a first mode of use of the machine of the invention, in which the launching arm 9 is mounted in such a way as to have a rotation in a clockwise direction, the barrel 3 operating in the counterclockwise direction. FIGS. 2 and 4 illustrate another mode of use of the machine of the invention, in which the barrel 3 continues to rotate in the counterclockwise direction but in which the launching arm 9 rotates in the counterclockwise direction and no longer in the clockwise direction. Thus, in the case of FIGS. 1 and 3, the targets are projected by the left side of the machine, whereas in FIGS. 2 and 4, they are projected by the right side. In order to produce these two operating modes of the machine, the present invention only requires minor modifications and in particular preferably the reversal of the launching arm 9 and of the receiving surface 12.

Nevertheless, the present invention does not involve a modification of the system for storage and loading of the targets onto the receiving surface 12 and in particular the barrel 3 is not modified. Thus, it is noted that in the two operating modes of the machine, the barrel 3 continues to rotate in the same direction.

Preferably, at least one of the aspects described above with regard to the height offset between the support 2 and the receiving surface 12 and the presence of a deflector 16 is implemented in such a way that, regardless of the direction of rotation of the launching arm 9, the target 13 is brought onto the receiving surface 12 almost of the hole 14 in such a way that the reversal of the direction of rotation of the arm 9 does not fundamentally influence the launching of the target 13.

In addition or alternatively with these previous aspects, the present invention can comprise the ability to adjust the machine in such a way as to modify the relative angular position between the support 2 and the chassis 1 and compensate for the effect of the change in rotation of the arm 9. For this purpose, the support 2 can be mounted on the chassis 1 between a first position and at least a second position, these two positions having an angular offset along the axis of rotation 10 of the barrel or an axis that is parallel to it. It is therefore possible, for example, to compensate for the residual offset $L_2$ or $L_3$ or $L_1$ of the target 13 in both directions of rotation (indeed, it should be recalled that by reversing the direction of rotation of the launching arm 9 without reversing the direction of rotation of the barrel 3, the effect of the offset $L_1$, $L_2$, $L_3$ is reversed for the relative position of the target 13 in position on the receiving surface 12 relative to the launching arm 9).

To carry out the angular position adjustment of the support 2, the latter preferably comprises a first anchoring zone 17 and at least a second anchoring zone 18 at which the support 2 can alternatively be attached to the chassis 1. For example, the first and second anchoring zones 17, 18 can be holes passing through the support 2 and allowing the formation of a point for attachment of the support 2 with respect to the chassis 1. Nevertheless, an oblong hole or other mode of continuous adjustment of the angle of the support can be suitable. Preferably, the holes 17, 18 are also used to carry out the mounting of the axis of rotation 11 of the arm 9 therein. Thus, two alternative positions that adjust the angular offset between the support 2 and the chassis 1 are produced while mounting the rotatable launching arm 9.

It should be noted that the axis of rotation 10 of the barrel is advantageously parallel to the axis of rotation 11 of the arm. Likewise, the angular displacement between the support 2 and the chassis 1 occurs about an axis parallel to the two previous axes.

The pivoting of the support 2 between two angular positions preferably happens along an axis parallel to the axis of rotation of the barrel 3. FIG. 10 shows an example of a position of the pivot axis 20 of the support 2.

The result of the invention is particularly surprising because although a barrel 3 always rotating in the same direction of rotation is used, two machine configurations can be achieved (with rotation of the launching arm 9 in the counterclockwise or clockwise direction) without disturbing the direction of the shot. For example, in the illustration of FIGS. 3 and 4, despite the reversal of the direction of rotation of the arm 9, the shooting direction does not change in the sense that the trajectories resulting from these two operating modes of the machine are parallel. The effect of the offset of the target 13 during its fall onto the receiving surface 12 is thus completely eliminated.

REFERENCES

1. Chassis
2. Support
3. Barrel
4. Column
5. Rod
6*a*. Lower frame
6*b*. Upper frame
7. Motor
8. Retaining surface
9. Arm
10. Axis of rotation of the barrel
11. Axis of rotation of the arm
12. Receiving surface
13. Target
14. Hole
15. Edge of the hole
16. Deflector
17. First anchoring zone
18. Second anchoring zone
19. Transfer zone
20. Pivot axis

The invention claimed is:

1. A machine for launching targets, comprising a chassis on which a support is mounted, relative to which a barrel is mounted rotatably about an axis of rotation, the barrel comprising a plurality of columns for storing stacked targets, the columns each having a longitudinal axis parallel to the axis of rotation, the chassis comprising a surface for receiving targets for a launch, the support comprising a hole configured to allow the passage of a target from a column of the barrel to the receiving surface, wherein the support comprises a first locking position with respect to the chassis and at least a second locking position with respect to the chassis, the first position and the second position having an angular offset along the axis of rotation.

2. The machine according to claim 1, wherein the angular offset is between 2° and 15°.

3. The machine according to claim 1, wherein a pivot link between the support and the chassis along the axis of rotation and a system for immobilizing the movement of the support on the pivot link in each of the first position and the second position.

4. The machine according to claim 1, wherein the distance separating the hole and the receiving surface along the direction of the axis of rotation is configured in such a way that the residual clearance between an upper surface of a target placed on the receiving surface of a lower surface of the support opposite the target is less than 3 mm.

5. The machine according to claim 1, wherein the support and the receiving surface are parallel.

6. The machine according to claim 1, comprising a deflector configured to guide a target passing through the hole towards the receiving surface.

7. The machine according to claim 6, wherein the deflector comprises a wall inclined with respect to the direction of the axis of rotation and located at the edge of the hole.

8. The machine according to claim 7, wherein the inclined wall is inclined at an angle of between 30° and 60° with respect to the direction of the axis of rotation when moving away from the center of the hole towards the receiving surface.

9. The machine according to claim 1, comprising an arm for launching a target positioned on the receiving surface, the arm being rotatably mounted in such way as to be reversible in two directions of rotation.

10. The machine according to claim 9, comprising a coupling device configured to produce a rotation of the barrel in a single direction of rotation during a rotation of the arm in one out of the two directions of rotation.

11. The machine according to claim 9, wherein the receiving surface is mounted on the chassis in a first position when the arm is mounted in a first direction of rotation and in a second position when the arm is mounted rotatably in a second direction of rotation.

12. A method for adjusting a machine according to claim 9, wherein the direction of launch of a target is adjusted by selecting one out of the first position and the second position of the support; and wherein the first position of the support is selected when the arm is mounted rotatably in the first direction of rotation and the second position is selected when the arm is mounted rotatably in the second direction of rotation.

13. The method according to claim 12, wherein the first position and the second position of the support are defined in such a way as to produce the same direction of launch of a target in the first and second directions of rotation of the arm.

14. A method for adjusting a launching machine according to claim 1, wherein the direction of launch of a target is adjusted by selecting one out of the first position and the second position of the support.

* * * * *